United States Patent [19]

Dalton

[11] 4,328,047

[45] May 4, 1982

[54] METHOD FOR INDUCING A PASSIVE SURFACE ON BERYLLIUM

[76] Inventor: William E. Dalton, 84-25 115th St., Richmond Hill, N.Y. 11418

[21] Appl. No.: 210,208

[22] Filed: Nov. 25, 1980

[51] Int. Cl.[3] ..... C23F 7/26

[52] U.S. Cl. ..... 148/6.2; 427/57

[58] Field of Search ..... 427/57; 148/6.2

[56] References Cited

U.S. PATENT DOCUMENTS

| | | | |
|---|---|---|---|
| 2,898,240 | 8/1959 | Owen | 427/57 |
| 3,084,020 | 4/1963 | Loosli | 427/57 |
| 3,301,718 | 1/1967 | Movana | 148/6.2 |
| 3,404,044 | 10/1968 | Russell | 148/6.2 |
| 3,485,682 | 12/1969 | Pearlstein et al. | 148/6.2 |
| 3,827,919 | 8/1974 | Keating | 148/6.16 |

*Primary Examiner*—Ralph S. Kendall

[57] ABSTRACT

The chemical process developed herein takes place in an aqueous solution containing a substance that acts as an electron acceptor ($CrO_3$) and a reagent (NaF) that behaves as a specific ligand for beryllium oxide. The combined effects of these two substances, coupled with non-turbulent flow conditions, produce a highly corrosion-resistant surface.

2 Claims, 8 Drawing Figures

METHOD FOR INDUCING A PASSIVE SURFACE ON BERYLLIUM

BACKGROUND OF THE INVENTION

This invention relates to a sono-chemical process that significantly improves the surface characteristics of beryllium enabling it to withstand several hundred hours of salt spray without corroding. Previous efforts to protect beryllium from corrosion have included costly anodizing and various, only partially successful attempts to apply passivation techniques. For example, U.S. Pat. No. 3,301,718 discloses a method for passivating beryllium using an aqueous solution containing potassium dichromate ($K_2Cr_2O_7$) or chromic anhydride ($CrO_3$) in combination with phosphoric acid. Both compounds contain hexavalent chromium ions, $Cr^{+6}$, which is well known as a component of aqueous passivating solutions for a variety of metal surfaces. U.S. Pat. No. 3,827,919 describes a two-step process for cleaning and passivating beryllium surfaces. In the first step, corrosion is removed from the surface using an oxalic acid solution containing a surfactant. The cleaning step is followed by a passivating step in which the surface is treated with a solution containing phosphoric acid, hexavalent chromium ions, and a surfactant. The patent suggests using an ultrasonic treatment in the first cleaning step to insure thorough removal of corrosion products on the surface prior to passivating. U.S. Pat. No. 3,404,044 teaches a method for passivating zinc-containing surfaces using an aqueous acid solution containing hexavalent chromium ions, fluoride ions and an activator compound.

The above patents have been cited since they relate in some respects to the principles employed in the present invention wherein an aqueous solution contains an electron acceptor ($CrO_3$) and a reagent (NaF) which behaves as a specific ligand for beryllium oxide. However, although ultrasonic sound has been employed (U.S. Pat. No. 3,827,919) to remove corrosion prior to passivation of beryllium, no prior process has employed the use of ultrasound (in a specifically controlled manner) in combination with a treatment bath, such combination producing a highly corrosion-resistant surface. We refer additionally to the special research report entitled "Electrodeposition of Metals in Ultrasonic Fields" by Kochergin and Vyaseleva, published by Vysshaya Shkola Press in Moscow (1964) and republished in 1966 by Consultants Bureau Enterprises, Inc., New York. This reference report deals with various phenomena induced by ultrasonic vibration in connection with the deposition of materials and electrolytic plating and is a definitive report in this field. However, the principle and method of the present invention (Dalton Process) has not been suggested or disclosed in the prior art.

SUMMARY OF THE INVENTION

More particularly, the present invention concerns a passivation treatment for beryllium employing the use of an aqueous bath containing sodium fluoride (NaF) and chromic acid ($CrO_3$) wherein the ratio of $CrO_3$ to NaF is about 15:1 by weight, the bath having a pH of about 1.7.

In accordance with the invention, beryllium having a machined surface (16 to 32 u inches) to be passivated is placed in the above-described solution whose temperature is in the range of 20° C. to 30° C. The bath is agitated by an ultrasonic transducer, however, in a controlled manner such that the ultrasonic agitation of the bath is maintained below cavitation (i.e. without formation of bubbles). The result is an extremely smooth surface of beryllium oxide which resists corrosion extremely well; and in fact after being subjected for 200 hours to salt spray, evidences no effects of corrosion.

BRIEF DESCRIPTION OF THE DRAWING

FIGS. 1*a*–3*a* are respectively schematically illustrations of untreated beryllium having a surface layer of BeO;

DESCRIPTION OF A PARTICULAR EMBODIMENT

Figure 4:
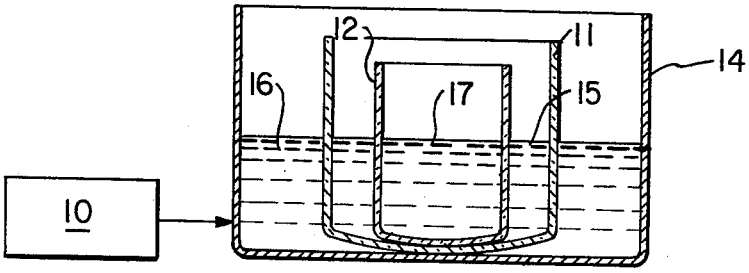
FIG. 4 illustrates one form of apparatus for treating beryllium in accordance with the present invention.

Prior to being processed, machined beryllium samples (1" in diameter by 3/16" thick) were pre-cleaned in a dilute alkali solution to remove any grease or oil and then rinsed in water. The following steps embody the treatment designed to improve the surface of beryllium:

(a) A typical ultrasonic device comprised of a 80 KHz generator 10 (See FIG. 4) vibrating a stainless steel tank was employed to agitate the treatment bath.

(b) A concentric arrangement of two glass beakers 11 and 12 in the tank 14 maintained the acoustical energy of the bath below the cavitational threshold. Thus, one can achieve uniform mass transport of reagents in the bath. Reference numerals 15 and 16 represent $H_2O$ in the beaker 11 and tank 14 while numeral 17 represents the treatment bath in beaker 12.

Figure 1A:
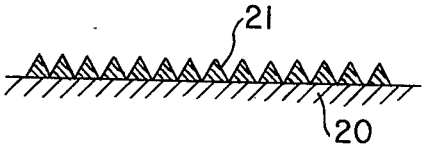

(c) The operating parameters of the bath are as follows:

Composition:
- Sodium Fluoride (NaF) 10 mg/100 ml water
- Chromic Acid ($CrO_3$) 100–165 mg/100 ml water
- Optimum ratio of $CrO_3$/NaF to be about 15:1 by weight pH: 1.6–2.0
Temperature: 20° C. to 30° C.
Treatment Time: 5 to 15 minutes Referring to FIGS. 1–3, it may be observed that FIGS. 1*a*–3*a* similarly and schematically represent untreated beryllium 20 wherein reference numeral 21 illustrates a thin film of BeO which typically and naturally forms on the surface of beryllium. Prior to the formation of the film 21, the surface of the beryllium is highly polished, but notwithstanding this fact the oxide film microscopically would have peaks and valleys as represented schematically in the drawing. Because of these irregularities and the known tendency for foreign ions to concentrate in the vicinity of points or prominences, this oxide film does not protect against corrosion, and the film will be broken down to the base metal in a corrosive environment.

Figure 1B:
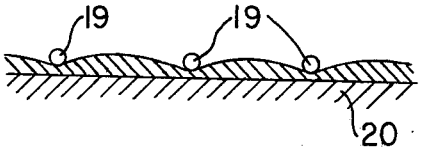
FIG. 1*b* illustrates the effect which a chromic acid bath containing sodium fluoride might have upon an untreated surface.
Figure 2A:
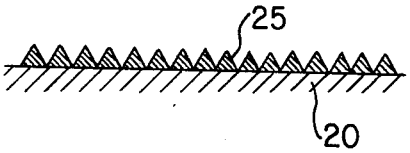
Figure 2B:
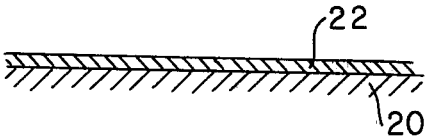
FIG. 2*b* illustrates the effect of controlled ultrasonic agitation in combination with a chromic acid bath.
Figure 3A:
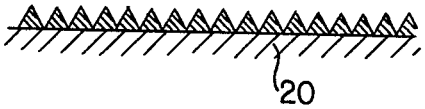

In accordance with the objectives of the invention, it is highly desirable to convert the film of FIGS. 1a–3a to the highly protective film as shown in FIG. 2b. FIG. 1b represents what would typically occur if the material depicted in FIG. 1a were simply treated by immersion in a bath containing chromic acid ($CrO_3$) and sodium fluoride (NaF). In this case, the fluoride ion dissolves BeO forming the soluble $BeF_4$=complex. The Be metal hydrolyzes (reacts with $H_2O$) to form BeO and $H_2$. The role of the hexavalent chromium is to oxidize $H_2$ and/or Be metal to produce a new, more protective oxide-film; however, in the absence of ultrasound, concentration gradients exist at the solution/oxide interface. Thus, hydrogen 19 can accumulate at recesses, become adsorbed, and cause defects in the oxide-layer.

Figure 3B:
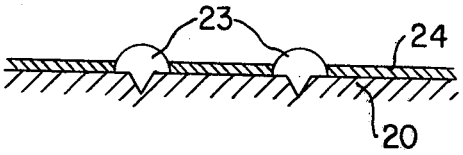
FIG. 3*b* illustrates the effect of such a bath in combination with uncontrolled ultrasonic agitation of the bath.

FIG. 3b represents the use of ultrasound in combination with the same treatment bath described in connection with FIG. 1b. However, FIG. 3b diagrammatically illustrates what will happen if the use of ultrasound is uncontrolled, that is to say, causes cavitation of the liquid. In this case, the implosion of cavitation bubbles 23 at the surface of BeO film 24 causes a suction effect. This leads to rupture of the film 24 and pitting and a BeO surface of poor corrosion-resistance. FIG. 2b illustrates what will happen with the use of ultrasound properly controlled, that is, to minimize cavitation. In this illustration, the orderly nature of mass transfer resulting from ultrasound accomplishes the following:

(a) The accumulation of hydrogen in recessed areas ($Be+H_2O \rightarrow BeO+H_2$) is prevented.

(b) A more uniform removal of the natural BeO film at the points 25 or projected areas (See FIG. 2a) is facilitated because the fluoride ion forms a soluble complex with BeO.

(c) The transport of hexavalent chromium to the surface is enhanced, allowing this substance to form new oxide-film and/or oxidize any hydrogen that may be adsorbed by BeO.

The net result is a solid, unbroken film of BeO which is basically impervious to corrosion.

Figure 5:
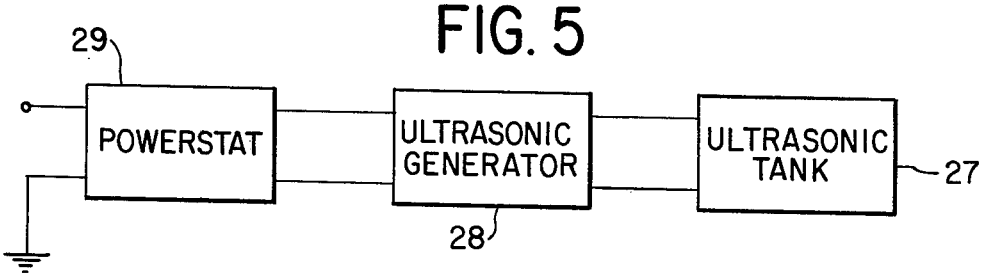
FIG. 5 illustrates a method of controlling ultrasound agitation in order to reduce cavitation of the reagent solution.

Referring to FIG. 5. one approach for controlling sound intensity has been illustrated. Assuming that the ultrasonic tank 27 contains the solution and parts to be processed, the tank may be subjected to ultrasonic vibration by generator 28 whose output is controlled by the powerstat 29. The amount of power selected will of course be determined by the size of the ultrasonic generator, the size of the tank 27 and the volume of its contents. This can be determined empirically since the use of ultrasound at too high levels will cause cavitation of the liquid and will result in the type of film depicted in FIG. 3b.

Samples treated in accordance with the present invention (FIG. 4) have withstood the corrosive effects of salt spray per ASTM B117-64 for 200 hours without any corrosive effect. The results of treatment by the inventive process experience negligible tolerance changes. The nature of the treatment insures homogeneous covering of recessed areas and a high degree of batch process reliability. The improved corrosion resistance surface renders it an excellent base for subsequent paint or lacquer finish, and the treatment actually improves the specular reflectance of the surface. The simplicity and ease of this treatment offers cost advantages over other processes, for example, anodizing. Finally, the stable nature of the conversion coating minimizes the well-known toxic effects of handling beryllium.

It will be understood that the foregong description has been of a specific embodiment and is therefore representative. In order to understand the scope of the invention, reference should be made to the appended claims.

I claim:

1. A sonochemical method for passivating beryllium comprising the steps of:

(a) providing the surface areas to be treated of a beryllium piece with a smooth, polished surface, (b) immersing said piece in an aqueous solution having a predetermined temperature and containing sodium fluoride (NaF) and chromic acid ($CrO_3$), (c) subjecting said solution to ultrasonic agitation, (d) controlling said ultrasonic agitation to be below the cavitation level of said solution; and (3) maintaining the aforesaid level of ultrasonic agitation for a selected period of time.

2. The method according to claim 1 wherein the pH of the bath is from 1.6 to 2.0, the temperature of the bath is from 20° C. to 30° C. and the time of treatment by immersion and by the use of ultrasonic agitation is from 5 to 15 minutes.

* * * * *